United States Patent [19]

Stillwell

[11] Patent Number: 4,627,592

[45] Date of Patent: Dec. 9, 1986

[54] EASEL

[76] Inventor: Merriam B. Stillwell, Rte. 1, Six Mile, S.C. 29682

[21] Appl. No.: 671,558

[22] Filed: Nov. 15, 1984

[51] Int. Cl.[4] ..... A47B 97/04

[52] U.S. Cl. ..... 248/465; 248/449; 248/455

[58] Field of Search ..... 248/460, 463, 464, 465, 248/449, 462, 455

[56] References Cited

U.S. PATENT DOCUMENTS

| | | | |
|---|---|---|---|
| 71,858 | 12/1867 | Dechause | 248/464 |
| 337,512 | 3/1886 | Mead | 248/449 |
| 385,536 | 7/1888 | Van Wart | 248/449 |
| 423,151 | 3/1890 | Hann | 248/449 |
| 694,979 | 3/1902 | Mueller | 248/464 |
| 962,903 | 6/1910 | Kristofek | 248/465 |
| 1,625,904 | 4/1927 | Mattson | 248/464 |
| 2,019,214 | 10/1935 | Denny | 248/449 |
| 3,304,045 | 2/1967 | Bethoney | 248/465 X |
| 3,512,486 | 5/1970 | Blanchard | 248/456 X |

*Primary Examiner*—J. Franklin Foss

*Assistant Examiner*—David L. Talbott

*Attorney, Agent, or Firm*—Dority & Manning

[57] ABSTRACT

A collapsible easel including a body with an elongated central member having side body members with legs depending therefrom pivotally secured along opposite elongated edges of the central member. A rear leg is pivotally secured to a rear side of the central member with a lower free end being movable away therefrom to cooperate with legs of the side body members to support the easel in a standing position. A pivotal locking element is provided between the central member and the rear leg to lock the rear leg in the open position. An article receiving platform or the like is removably securable across the body in the operative position to support an article. The receiving platform may also be secured to the central member parallel to a longitudinal axis of same and to the locking element and rear leg in the collapsed position to hold the various easel parts in place while the side members hang free. A handle may be provided on the receiving platform or otherwise for transport of the collapsed easel.

16 Claims, 5 Drawing Figures

EASEL

BACKGROUND OF THE INVENTION

The present invention relates to an improved easel, generally of the type used by artists or in presenting charts or other visual presentations or the like.

Easels have heretofore existed in known constructions to include tripod arrangements where three legs are joined at the apex of the tripod and are movable outwardly at the outer free ends of same to define the tripod. A horizontal tray or the like is secured between two of the legs to secure the legs in the separated position, and likewise be available for receipt of a canvas or other article to be supported by the tray and upper portions of the two legs. The third leg of this type easel, extends rearwardly with respect to the front legs generally transverse to the article supporting tray. Some type of fastening means such as bolts with wing nuts are generally utilized at the apex of the tripod to secure the legs in an open or closed position, and for securement of the tray to the two front legs.

In a further prior art easel, the legs and elements used to interrelate the legs are all separable such that individual elements may be stored in a box for storage and/or transport, and at the point of use, may be assembled into a conventional tripod easel assembly. These types of easels are generally intended for temporary use, and are often quite small and unstable in use.

In a further, more permanent type easel, a tripod foundation is still utilized, though the two front legs that support the article receiving tray are permanently secured in their separated or bifurcated position with the third or rear leg being pivotally associated at the apex of the first two legs. With such arrangement, for storage the rear leg is simply brought into a position immediately adjacent and behind the first two legs.

While all of the above types of easels will adequately support an artist's canvas, a graph, chart or other visual aid, each is fraught with certain problems. The generally portable or collapsible easel, whether with discrete separable elements or legs that are permanently secured at an apex and are movable inwardly and outwardly at the outer free ends of same to form a tripod or to collapse the easel, are generally lightweight in nature due to the totally skeletal nature of same. Hence, once a canvas or other article is received in a supporting relationship thereon, the overall system is less than stable. In fact, working around the easel one often overlooks the protruding leg due to a lack of bulk or mass, and is apt to trip over the leg, kick the leg or the like, any of which may overturn the easel and/or the item supported thereon. Conversely, the standard studio type easel, with two front legs permanently secured in the desired disposition, and only the rear leg pivotally connected is much more stable than the types previously discussed, but is very cumbersome to move about. Generally such easels are not intended for transport, but are normally maintained for permanent and continuous use at the initial point of installation.

Easels according to the present invention overcome both of the problems of the known prior art easels, in that, a greater bulk or mass is provided which better supports a canvas or other item thereon, and renders the easel much more visible than the skeletal conventional, collapsible easels. Present easels are thus much less likely to be kicked or tripped over. Additionally, easels according to the present invention are collapsible into a convenient transportable mode which, when considered in conjunction with the increased mass renders same ideal for out-of-doors use.

There is no known prior art that is believed to anticipate or suggest the easel of the present invention.

SUMMARY OF THE INVENTION

It is an object of the present invention to provide an improved easel.

Another object of the present invention is to provide an improved easel of the type that is utilized by artists or for display of visual aid materials.

Still further another object of the present invention is to provide an improved easel that is more visible to one working around same, while providing better overall support for an article received thereon, while being collapsible to a convenient transportable size.

Yet another object of the present invention is to provide an improved collapsible artist's easel.

Still another object of the present invention is to provide an improved collapsible easel that may be very simply adjusted for particular use, and easily erected and collapsed.

Generally speaking, the improved easel according to teachings of the present invention comprises a body, said body comprising an elongated central member, a first side body member hingedly secured along an edge of said elongated central member and a second side body member hingedly secured along an opposite edge of said central member, said first and second side members being movable about their respective hinge securement between an operative position in which said side members and said central member are generaly coplanar and a collapsed position in which said side members are turned rearwardly, generally transverse to said central member, said side members further having depending legs secured thereto; at least one rear leg pivotally secured at its upper end to said body, an opposite free end of said leg being movable away from said body and cooperating with said side member legs when in the operative position for support of said easel; means to secure said at least one rear leg in a support position; an article receiving means securable in a generally horizontal disposition across said body in the operative position, said article receiving means and said body cooperating to support an article thereon.

More specifically, the easel of the present invention preferably includes two side body members that are of unitary construction with respective leg portions, with the body members being solid and planar to add bulk to the overall appearance of the easel and add additional support for an article received thereon. Further in this regard, due to the solid construction of the side body members, rigidity of the easel is enhanced and various aesthetic designs may likewise be incorporated thereon.

In a most preferred arrangement, the central body member is shorter in length than the side body members, including the length of the legs depending therefrom and the body members are shaped to provide an open lower easel front. Such opening permits an artist to stand closer to the work, or as the case may be to suitably sit a chair, stool or the like closer to the work. The side body members are hingedly connected along opposite vertical edges of the central member with the hinge means being continuous in the form of a piano hinge or with separate hinges spread apart along the length of the central member. Preferably one rear leg is provided and is secured to a rear side of the central body member at an upper end of same. The lower free end of the leg may then be pivotally moved rearwardly with respect to the body thus cooperating with the body where in the operative position to form the tripod. In order to stabilize the tripod arrangement, a locking means is preferably provided between the central body member and the rear leg. Particularly, the locking means is an elongated member that is pivotally connected to either the rear leg or the central member with an opposite end free for movement between a collapsed and a locking position. Means are provided on the outer end of the elongated element to interrelate with means on the other of the central body member and leg to secure the relationship between same in the operative condition.

In a most preferred arrangement, in order to further collapsibility of the easel, a mounting plate is secured to the rear side of the central body member with the rear leg being pivotally secured to the plate. The thickness of the plate is at least as thick as the locking member that is pivotally secured to a lower portion of the central member or leg, whereby in the collapsed mode the various components are receivable immediately adjacent the rear side of the central member. In the collapsed condition, the article receiving means is separated from the side body members and is secured atop the central member with bolt means passing through the article receiving means, the central body member, the locking member, and the rear leg, whereby all of the elements, except the side body members are secured in the collapsed position. Further, in a most preferred embodiment, the article receiving means has a handle associated therewith which permits convenient transport of the collapsed easel. With a handle thus located atop the central body member, the side body members, while not being secured, suspend freely downwardly.

The article receiving means may be L-shaped in nature with one leg of the L residing adjacent the body and being removably securable in a horizontal disposition to the side body members at various locations along the length of same. Height variability of the article receiving means accommodates the artist using the easel and/or the article to be displayed thereon. In a preferred arrangement, a plurality of fastening member receiving openings are provided along a portion of the length of the side body members in matching pairs such that the article receiving means may be conveniently moved from one pair of openings to another to vary the height of same as desired. In like fashion, fastening member receiving openings are provided through the central body member, locking means and rear leg, spaced apart to accommodate the bolts or the like of the article receiving means as discussed above to secure the elements for transport.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENTS

Making reference to the figures, preferred embodiments of the present invention will now be described in detail.

Figure 1:
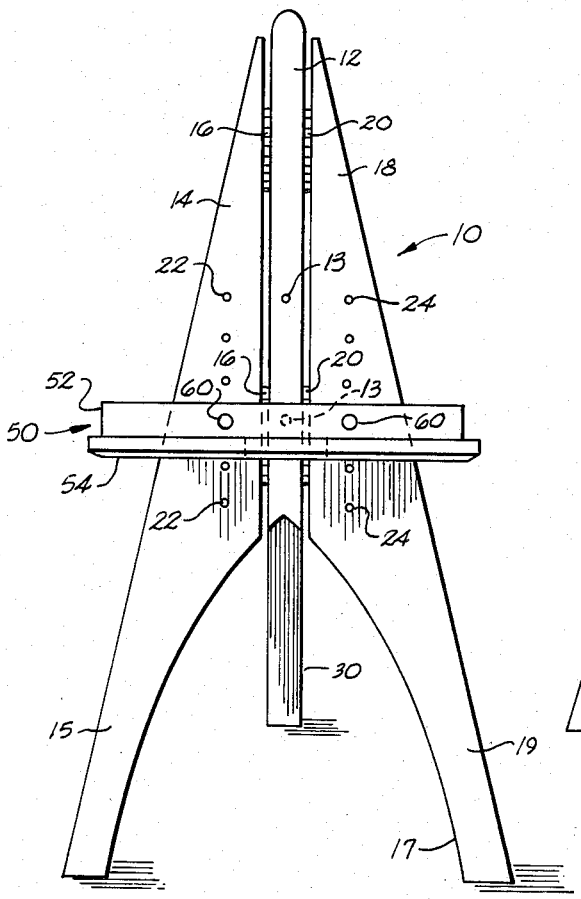
FIG. 1 is a frontal elevational view of an easel according to teachings of the present invention shown in an operative supporting position.
Figure 2:
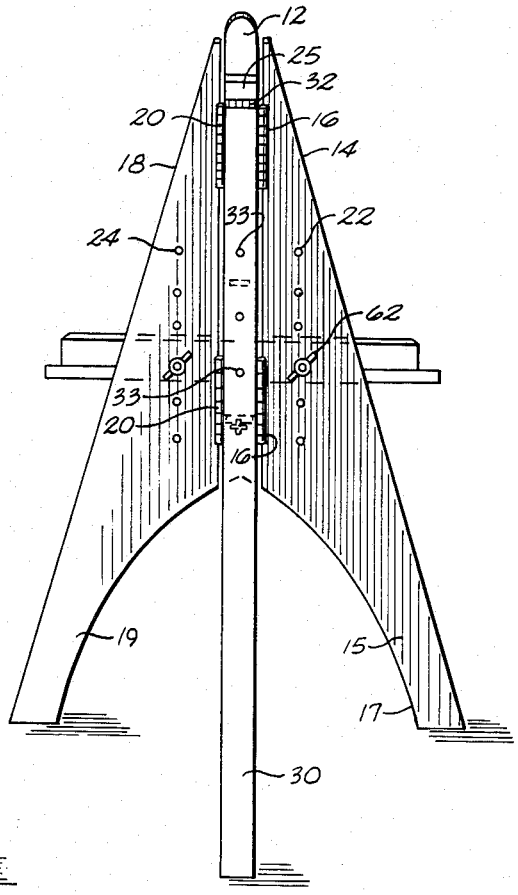
FIG. 2 is a rear elevational view of the easel illustrated in FIG. 1.
Figure 3:
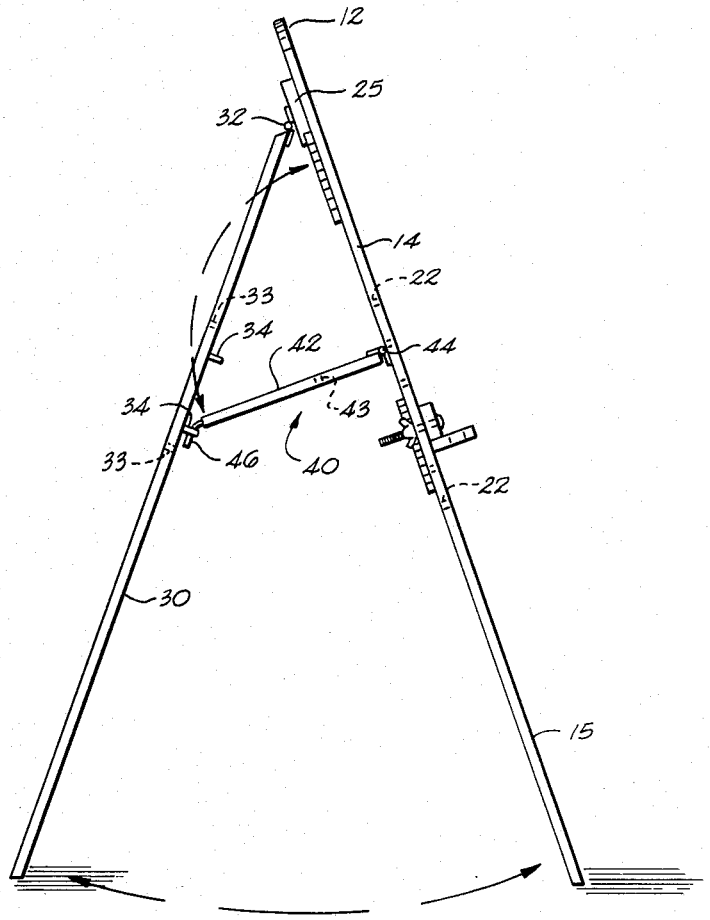
FIG. 3 is a side elevational view of the easel illustrated in FIG. 1.

In FIGS. 1–3, an easel according to the teachings of the present invention is illustrated in an erected, supporting position and includes a body generally indicated as 10 which is made up of a central vertical member 12, a first side member 14 hingedly secured by hinge means 16 along one edge of same, and a second side body member 18 hingedly secured by hinge means 20 along an opposite edge of same. First and second side body members 14 and 18 include legs 15 and 19, respectively, that are secured thereto and depend therefrom. As illustrated in FIG. 1, which is a preferred embodiment, side body members 14 and 18 are of unitary construction with their respective legs 15 and 19. Further, as illustrated, body members 12, 14 and 18 may be formed to afford some asethetic value to the overall easel. Note for example, the general pyramidal shape of the easel with an open arch shape defined by legs 15 and 19 and central member 12. Not only does the lower arch shape 17 afford aesthetic value to the easel, likewise the open space permits the artist or one using the easel closer access to the work or an article received thereon for greater flexibility in use. Side body members 14 and 18 further define a plurality of fastening member receiving openings 22, 24, respectively in vertical spaced-apart pairs, the purpose of which will be described in detail hereinafter.

A rear leg 30 is pivotally secured to a rear side of central body member 12, and preferably to a mounting block 25 that is, in turn, secured to a rear side of central body member 12 (see FIG. 3). While any suitable pivotal arrangement may be acceptable, a hinge means 32 is preferred. With side body members 14 and 18 in the operative position as illustrated in FIGS. 1–3, and with a lower end of rear leg 30 pivoted rearwardly away from central member 12, a tripod arrangement is provided with body 10 inclined from the vertical. In order to stabilize the tripod arrangement, a locking means generally indicated as 40 is provided, which in a preferred embodiment is an elongated element 42 that is hingedly secured at one end to one of central member 12 and rear leg 30 and which has latch means 46 at an opposite end that mates with a latch receiving element 34 located on the other of said member and leg for removable securement thereto. As illustrated in FIG. 3, elongated locking element 42 is hingedly secured to central body member 12 at hinge means 44 while an opposite free end of same has a hook 46 which is matingly engagable with one of several eyes 34 located along rear leg 30. Two such eyes 34 are illustrated at different positions along leg 30 whereby the attitude of inclination of the easel may be varied.

Elongated locking element 42 is pivotally connected to a lower portion of central body member 12. In the collapsed position as indicated by the double headed arrows, the locking member 42 may pivot upwardly to reside immediately adjacent the rear side of central body member 12. Rear leg 30 may then be brought into the collapsed position immediately adjacent central body member 12, residing atop locking element 42. Such arrangement renders the easel more compact in the collapsed position.

An article receiving means generally indicated as 50 is provided in a horizontal disposition in front of body 10 being removably secured thereto. As preferred, and as illustrated in the Figures, article receiving means 50 is L-shaped and includes a vertical leg 52 and a horizontal leg 54 secured along a lower edge of leg 52 and extending transversely outwardly therefrom, defining a supporting ledge. Securement of article receiving means 50 to body 10 is preferably achieved by securing vertical leg 52 to side body members 14 and 18 whereby body 10 is locked in the operative position to thus stabilize the easel. As illustrated in the figures, a pair of fastening members illustrated by bolts 60 are received in appropriate openings through vertical leg 52 and pass through correspondingly spaced openings 22, 24 of side body members 14 and 18. Wing nuts 62 are threadably received about bolts 60 on an opposite side of body 10 to secure article receiving means 50 to side body members 14 and 18. Obviously, the vertical location of article receiving means 50 may be varied up or down by placement of bolts 60 through an appropriate pair of fastening member receiving openings 22, 24 of side body members 14, 18, respectively. Though not shown, a third leg, parallel to leg 52 could be provided on means 50 to define a tray, or article receiving means 50 could be constructed in any other suitable fashion.

With the easel erected as described and as illustrated in the figures, as can be readily seen from the figures, significantly more mass is provided than with a structure that utilizes three skeletal legs with an article receiving means secured between two of the legs. The greater bulk of the present easel permits one to more easily visualize same with peripheral or direct vision whereby there is less likelihood of one using the easel to make inadvertent contact therewith. Moreover, since the side body members are preferably solid and planar in nature, a greater support surface is provided for an article received thereon.

Figure 4:
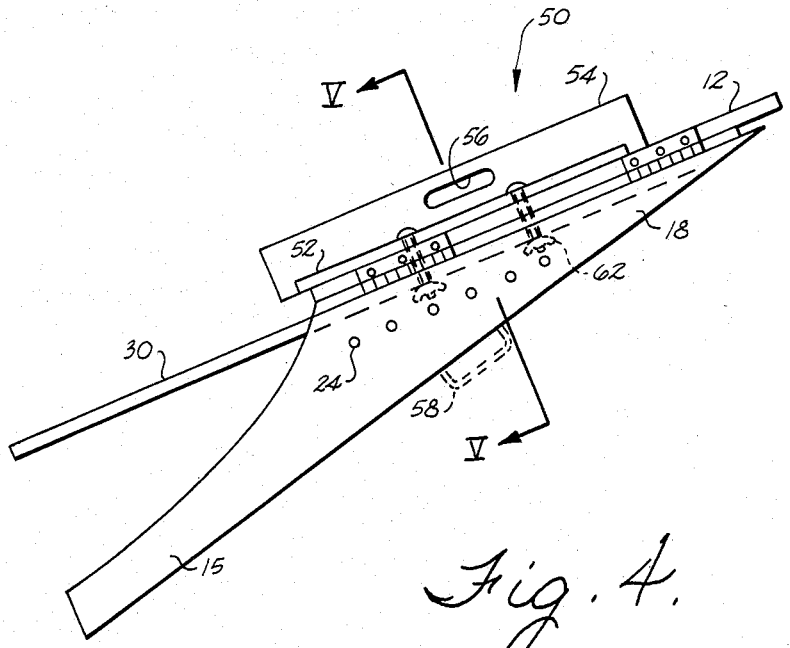
FIG. 4 is a side view of an easel as illustrated in FIG. 1, but in a collapsed condition.
Figure 5:
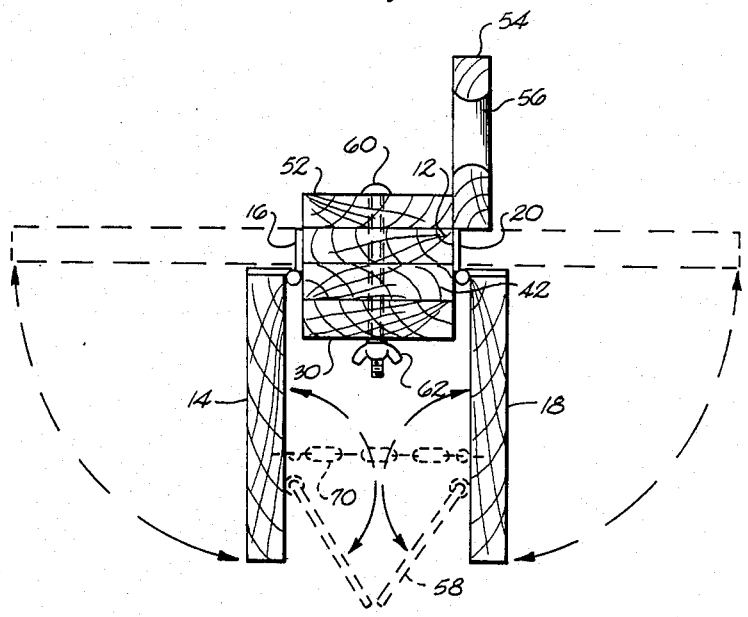
FIG. 5 is a vertical cross-sectional view through the collapsed easel of FIG. 4 taken along a line V—V.

Making specific reference to FIGS. 4 and 5, the collapsed mode of an easel according to the present invention is illustrated. The easel may be collapsed by removing wing nuts 62 from bolts 60 and lifting article receiving means 50 from body 10. Thereafter, locking means 40 may be disengaged from rear leg 30 and pivoted upwardly to a position immediately adjacent a rear side of the central body member 12 at which point rear leg 30 may be moved forwardly, also to a position immediately adjacent a rear side of central body member 12. With rear leg 30 being held in place, and in turn holding locking element 42 in place, article receiving means 50 may be oriented parallel to a longitudinal axis through central body member 12 where bolts 60 may extend through fastening receiving openings 13 of central body member 12, 43 of elongated locking element 42, and 33 of rear leg 30. Thereafter, wing nuts 62 may be reapplied to bolts 60 to lock these respective elements in the collapsed position.

It may also be seen in FIGS. 4 and 5 that horizontal leg 54 of article receiving means 50 defines a handle 56 therewithin. With article receiving means 50 located parallel to the longitudinal axis through central body member 12, such locates handle 56 in an appropriate location for lifting and transport of the easel. Also, with article receiving means 50 removed from side body members 14 and 18, members 14 and 18 may then pivot rearwardly about their respective hinges 16 and 20 (See FIG. 5) to hang unrestricted below the major mass of the easel. In a further embodiment of the present invention, as is illustrated in phantom in FIGS. 4 and 5, a pair of handles 58 may be affixed to an outer periphery of each of side body members 14 and 18 whereby the easel may then be grasped and transported from an opposite side to that illustrated in solid lines in FIG. 4. Further, in this carrying or transport arrangement, side body members 14 and 18 may then likewise be held in a compact fashion during the transport of the easel. Also as illustrated in phantom in FIG. 5, a securement means 70, such as a chain or the like may be secured between side members 14, 18 to hold same together, if desirable.

The easel according to the present invention may be manufactured from any suitable material. Due to convenience of working, availability, economy and the like, wood is preferred. In like fashion, while bolts and wing nuts are illustrated as suitable fastening members for securing article receiving means 50 in place, clamps or other types of fastening members may be utilized if appropriate. Likewise, though not illustrated it is within the purview of the present invention to utilize adjustable legs for the easel.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. An improved, collapsible easel comprising:

(a) a body, said body comprising an elongated central member, a first side member hingedly secured along an edge of said elongated central member and a second side member hingedly secured along an opposite edge of said central member, said first and second side members being movable about said hinge connections between an operative position in which said side members and said central member are generally coplanar and a collapsed position in which said side members are turned rearwardly, generally transverse to said central member, said side members further having depending legs secured thereto;

(b) at least one rear leg pivotally secured at its upper end to said body, an opposite free end of said leg being movable away from said body and cooperating with said side member legs when in said operative position for support of said easel;

(c) means to secure said at least one rear leg when same is moved away from said body for support of said easel; and (d) article receiving means securable in a generally horizontal disposition across said body in said operative position, said article receiving means and said body cooperating to support an article thereon.

2. An easel as defined in claim 1 wherein said side body members and said legs therefor are of unitary construction.

3. An easel as defined in claim 1 wherein said side body members and said central body member generally define a triangular body in said operative position, and wherein said article receiving means is securable at a plurality of different locations across said body.

4. An easel as defined in claim 1 wherein a single rear leg is provided, said rear leg being securable to said central member, whereby said body legs and said rear leg form a tripod for support of said easel.

5. An easel as defined in claim 4 wherein said rear leg locking means comprises an elongated element pivotally secured at one end to one of said central body member and said rear leg, an opposite end of said element being movable about said pivotal securement away therefrom and being removably securable to the other of said central member and said rear leg to secure said rear leg in spaced relation to said central member.

6. An easel as defined in claim 5 wherein said elongated member is hingedly secured to said central member and is movable downwardly about said hinge securement, said opposite end of said elongated member having means thereon for removable securement to said rear leg.

7. An easel as defined in claim 1 wherein said article receiving means is removably securable to said side body members at a plurality of locations, and is removably securable to said central member and said at least one rear leg in the collapsed position, said article receiving means having a handle means associated therewith for transport of said easel in the collapsed position.

8. An easel as defined in claim 7 wherein said article receiving means, said side body members, said central member and said at least one rear leg define fastening means receiving openings therein and further comprising fastening means for securing said article receiving means in the respective securement positions.

9. An easel as in claim 1, wherein said legs depending from said first and second side members define an arched-shaped opening enabling a user of said easel to stand close to articles supported by said article receiving means.

10. An improved, collapsible easel comprising:

(a) a body, said body comprising an elongated central member, first and second side body members pivotally secured generally lengthwise along opposite elongated edges of said central member, said side body members being solid and defining a plurality of matching fastening member receiving openings along the height of same, said body members further having depending legs of unitary construction therewith;

(b) a rear leg pivotally secured at its upper end to a rear of said central body member, an opposite free end of said rear leg being movable away from said central member and cooperating with said side member legs in the operative position for support of said easel;

(c) an elongated locking element pivotally secured to one of said rear leg and said central member and having an opposite free end of same pivotally movable toward and removably securable to the other of said central member and said leg; and (d) article receiving means removably securable in a generally horizontal disposition across said body in said operative position and cooperating with said body to support an article thereon, said article receiving means also being removably securable to said central body member, said locking element and said rear leg in a collapsed position.

11. An easel as defined in claim 10 wherein said article receiving means includes fastening means, and said central member, locking element and rear leg define fastening member receiving openings through which said fastening means pass to secure same in said collapsed position.

12. An easel as defined in claim 10 comprising further handle means secured to a portion of said easel for transport of same.

13. An easel as defined in claim 12 wherein said handle means is defined by a portion of said article securement means.

14. An easel as defined in claim 12 said handle means is secured to said side body members.

15. An easel as defined in claim 10 wherein said elongated locking element is pivotally secured to said central member and has a latch means at an outer free end of same, said rear leg having at least one latch receiving element therealong for receipt of said latch means.

16. An easel as in claim 10, wherein said legs depending from said first and second side members define an arched-shaped opening enabling a user of said easel to stand close to articles supported by said article receiving means.

* * * * *